US011842648B2

(12) United States Patent
John et al.

(10) Patent No.: US 11,842,648 B2
(45) Date of Patent: Dec. 12, 2023

(54) DISTRIBUTED MANAGEMENT OF AIRFIELD GROUND LIGHTING OBJECTS

(71) Applicant: Honeywell International Inc., Charlotte, NC (US)

(72) Inventors: Shyju John, Bangalore (IN); Ganesh Vijayamani, Kannur (IN); Dhyan K. Pasi, Borbil (IN); Chandra Gangineni, Bangalore (IN); Manjunath Bj, Bangalore (IN); Kaushik Paul, Bangalore (IN); Soniya Thiyagarajan, Peravurani (IN); Franklin Joseph, Bangalore (IN)

(73) Assignee: Honeywell International Inc., Charlotte, NC (US)

( * ) Notice: Subject to any disclaimer, the term of this patent is extended or adjusted under 35 U.S.C. 154(b) by 15 days.

(21) Appl. No.: 17/539,873

(22) Filed: Dec. 1, 2021

(65) Prior Publication Data

US 2023/0169875 A1 Jun. 1, 2023

(51) Int. Cl.
*G08G 5/00* (2006.01)

(52) U.S. Cl.
CPC ..... *G08G 5/0043* (2013.01); *G08G 5/0026* (2013.01)

(58) Field of Classification Search
CPC ..... G08G 5/0043; G08G 5/0026
See application file for complete search history.

(56) References Cited

U.S. PATENT DOCUMENTS 5,359,325 A * 10/1994 Ford ..... H05B 47/235 315/130

FOREIGN PATENT DOCUMENTS

| | | | | |
|---|---|---|---|---|
| AU | 2019233731 A1 * | 10/2020 | ..... | G01S 13/91 |
| DE | 10026923 A1 * | 2/2002 | ..... | G08G 5/0026 |
| EP | 1071061 A1 * | 1/2001 | ..... | B64F 1/18 |

OTHER PUBLICATIONS

Reliance Power ACE3 Advance Control Equipment L-827/L8-29, 2018, Manual No. 96A0500 (Year: 2018).*

* cited by examiner

*Primary Examiner* — Curtis A Kuntz
*Assistant Examiner* — James E Munion
(74) *Attorney, Agent, or Firm* — Brooks, Cameron & Huebsch, PLLC

(57) ABSTRACT

Devices, systems, and methods for distributed management of airfield ground lighting objects are described herein. In some examples, one or more embodiments include a first substation management computing device (SMCD), where the first SMCD is in communication with a first number of airfield ground lighting objects associated with a first portion of an airfield and the first SMCD is configured to control the first number of airfield ground lighting objects in response to receiving a control signal, and a second SMCD, where the second SMCD is in communication with a second number of airfield ground lighting objects associated with a second portion of the airfield, and the second SMCD is configured to control the second number of airfield ground lighting objects in response to receiving a different control signal.

19 Claims, 4 Drawing Sheets

| | | |
|---|---|---|
| 218 | STATUS INFORMATION | |
| 220-1 | HEALTH STATUS | HEALTHY |
| 220-2 | OPERATIONAL STATUS | ON |
| 220-3 | OPERATIONAL INTENSITY | HIGH |
| 220-4 | RUNTIME | 1,037 HOURS |

Fig. 2

DISTRIBUTED MANAGEMENT OF AIRFIELD GROUND LIGHTING OBJECTS

TECHNICAL FIELD

The present disclosure relates to devices, systems, and methods for distributed management of airfield ground lighting objects.

BACKGROUND

Airfields can include lighting systems to provide visual cues and/or signals for the airfield. For example, airfield lighting systems can include luminaires and/or other airfield ground lighting objects in order to direct aircraft and/or other vehicles in and/or around the airfield. Such airfield luminaires can provide visual cues and/or signals for aircraft and/or other vehicles in and/or around approach areas, runways, taxiways, etc.

BRIEF DESCRIPTION OF THE DRAWINGS

FIG. 2 is an example of status information of an airport object, in accordance with one or more embodiments of the present disclosure.

DETAILED DESCRIPTION

Figure 1:
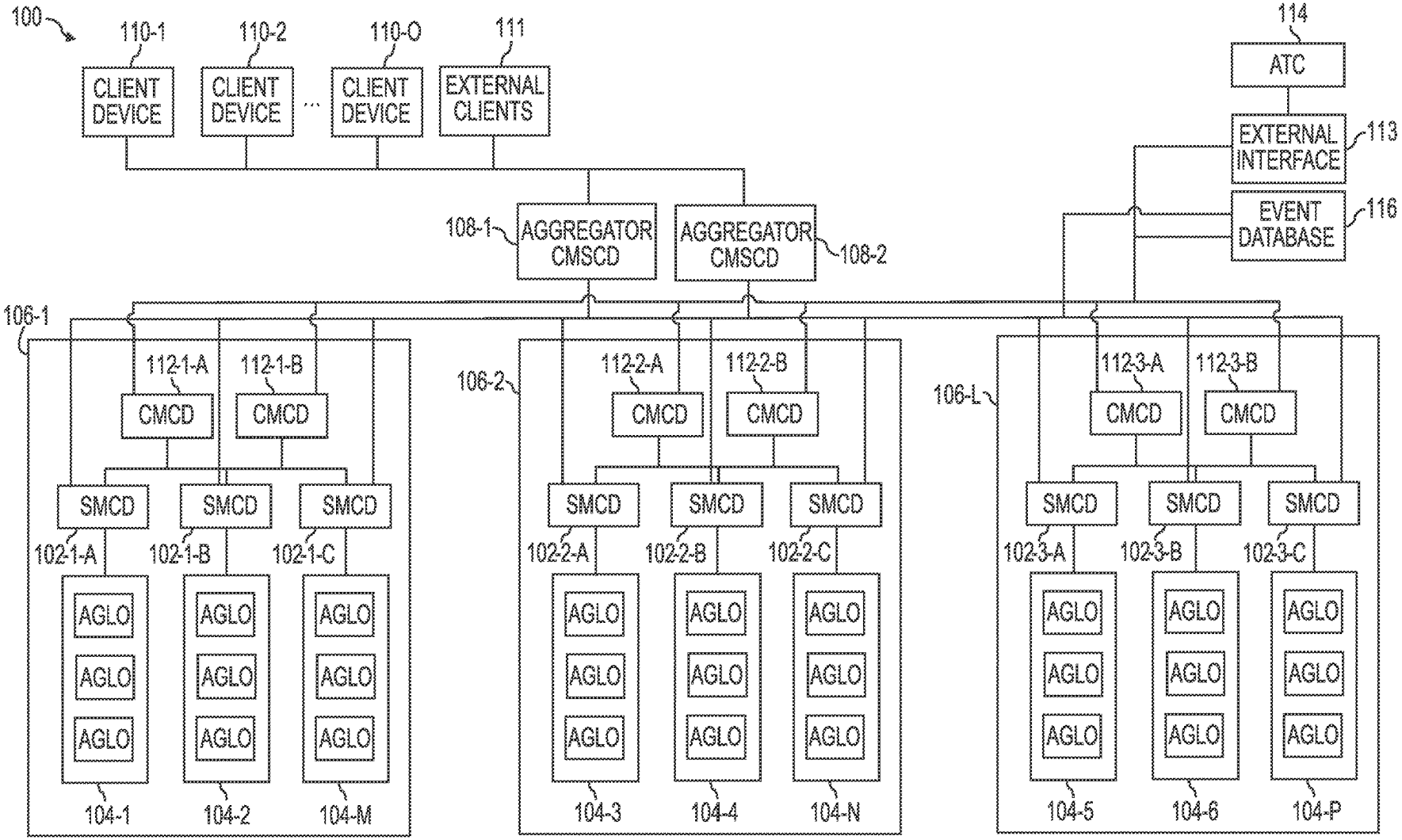
FIG. 1 is an example of a system for distributed management of airfield ground lighting objects, in accordance with one or more embodiments of the present disclosure.

Devices, systems, and methods for distributed management of airfield ground lighting objects are described herein. In some examples, one or more embodiments include a first substation management computing device (SMCD) (or first set of SMCDs), where the first SMCD is in communication with a first number of airfield ground lighting objects associated with a first portion of an airfield and the first SMCD is configured to control the first number of airfield ground lighting objects in response to receiving a control signal, and a second SMCD (or second set of SMCDs), where the second SMCD is in communication with a second number of airfield ground lighting objects associated with a second portion of the airfield, and the second SMCD is configured to control the second number of airfield ground lighting objects in response to receiving a different control signal.

Airfields can include airfield ground lighting objects. Airfield ground lighting objects can be, for example, an object associated with an airfield to provide monitoring and/or control of airfield operations. For example, airfield ground lighting objects can include airfield luminaires, transformers, etc. Airfield luminaires can be utilized around an airfield to provide visual cues and/or signals for aircraft and/or other vehicles in and/or around approach areas, runways, taxiways, etc., and may be controlled via transformers and/or other airfield ground lighting objects.

An airfield can include various portions that can be utilized by aircraft and/or other vehicles. For example, a first portion of an airfield can be a taxiway where aircraft taxi between parking areas and a runway and a second portion of the airfield can include the runway where aircraft take off from the airfield and land at the airfield.

The portions of the airfield can include airfield ground lighting objects. Airfield ground lighting objects can include, for example, airfield luminaires to direct aircraft and/or other vehicles around the portions of the airfield. Such portions of the airfield may include different configurations of airfield ground lighting objects. For example, a runway can include different configurations and control schemes of airfield luminaires than a taxiway, as the runway is utilized for a different purpose than a taxiway.

In order to implement, maintain, and/or operate such configurations and control schemes, a monitoring and control system may be utilized for the airfield. The monitoring and control system can be setup such that the airfield ground lighting objects associated with the airfield are considered to be a single system when implementing configuration and control schemes.

However, in an instance when the airfield is undergoing expansion and/or when an untoward event occurs that affects the airfield ground lighting objects (e.g., outages, emergency situations, etc.), the monitoring and control system may lose control of the airfield ground lighting objects across the airfield as a result of the single system implementation for configuration and control. This can result in downtime for the entire airfield, as the airfield ground lighting objects are not operational. Further, previous approaches included a single central management device (e.g., central management computing device) and backup central management device that manage all of the airfield ground lighting objects for the airfield. However, if both the central management device and its backup go down, management of the airfield ground lighting objects is suspended for the whole airfield, resulting in downtime for the entire airfield.

Distributed management of airfield ground lighting objects according to the present disclosure can allow for distributed control of airfield ground lighting objects according to portions of an airfield. For example, control of one portion of airfield ground lighting objects associated with a first portion of the airfield can be separated from control of another portion of airfield ground lighting objects associated with a second portion of the airfield. Additionally, central management devices are distributed for each of the portions of the airfield. Accordingly, in an instance when the airfield is undergoing expansion and/or when an untoward event occurs that affects the airfield ground lighting objects, only a portion of the airfield may be affected. As a result, only a portion of the airfield ground lighting objects are not operational while the remaining portions of the airfield remain operational. Further, if a problem with a central management device arises, only the portion of the airfield associated with the central management device may be affected. Such an approach can provide scalability for expanding airfields, as well as reduce operational downtime as compared with previous approaches.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that process, electrical, and/or structural changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits. For example, 106 may reference element "06" in FIG. 1, and a similar element may be referenced as 306 in FIG. 3. Additionally, the designators "M", "N", "0", and "P", as used herein, particularly with respect to reference numerals in the drawings, indicate that a number of the particular feature so designated can be included with a number of embodiments of the present disclosure As used herein, "a", "an", or "a number of" something can refer to one or more such things, while "a plurality of" something can refer to more than one such things. For example, "a number of components" can refer to one or more components, while "a plurality of components" can refer to more than one component.

FIG. 1 is an example of a system 100 for distributed management of airfield ground lighting objects, in accordance with one or more embodiments of the present disclosure. The system 100 can include substation management computing device (SMCD) 102-1-A, 102-1-B, 102-1-C, 102-2-A, 102-2-B, 102-2-C, 102-3-A, 102-3-B, 102-3-C (referred to collectively herein as SMCDs 102), airfield ground lighting objects (AGLO) 104-1, 104-2, 104-M, 104-3, 104-4, 104-N, 104-5, 104-6, 104-P (referred to collectively herein as AGLOs 104), portions of an airfield 106-1, 106-2, 106-L, aggregator control and monitoring system computing device (CMSCD) 108-1, 108-2, client devices 110-1, 110-2, 110-O, external client 111, central management computing device (CMCD) 112-1-A, 112-1-B, 112-2-A, 112-2-B, 112-3-A, 112-3-B (referred to collectively herein as CMCDs 112), external interface 113, air traffic control (ATC) 114, and event database 116. Further, although FIG. 1 illustrates the SMCDs 102-1-A, 102-1-B, 102-1-C, 102-2-A, 102-2-B, 102-2-C, 102 A, 102-3-B, 102-3-C as single SMCDs each controlling AGLOs 104, embodiments of the present disclosure are not so limited. For example, each of the SMCDs 102-1-A, 102-1-B, 102-1-C, 102-2-A, 102-2-B, 102-2-C, 102-3-A, 102-3-B, 102-3-C can include a redundant backup SMCD such that redundant pairs of SMCDs 102 in each portion 106 each control AGLOs 104 (e.g., a redundant pair of SMCDs 102-1-A controls AGLO 104-1, a redundant pair of SMCDs 102-1-B controls AGLO 104-2, etc.), as is further described herein.

As illustrated in FIG. 1, the system 100 can include various devices that are associated with an airfield. The airfield can include portions 106-1, 106-2, 106-L. Such portions of the airfield can be associated with physical areas on the airfield. For example, portion of the airfield 106-1 can be a taxiway, portion of the airfield 106-2 can be a runway, portion of the airfield 106-L can be an expansion taxiway, etc.

Such portions 106-1, 106-2, 106-L of the airfield can include associated AGLO 104. For example, portion of the airfield 106-1 can include associated AGLO 104-1, 104-2, 104-M, portion of the airfield 106-2 can include associated AGLO 104-3, 104-4, 104-N, portion of the airfield 106-L can include associated AGLO 104-5, 104-6, 104-P, etc. Such airfield ground lighting objects 104 associated with the portions of the airfield 106 can allow for distributed management of such airfield ground lighting objects 104, as is further described herein.

The system 100 includes aggregator CMSCD 108-1, 108-2. The aggregator CMSCD 108-1, 108-2 can be computing devices connected to the SMCDs 102 and can receive status information from the SMCDs as is further described herein.

The SMCDs 102 can be computing devices in communication with AGLOs 104. As mentioned above, the airfield ground lighting objects 104-1, 104-2, 104-M can be associated with a portion 106-1 of an airfield. In some embodiments, the portion 106-1 can be a taxiway. Accordingly, AGLOs 104-1, 104-2, 104-M can be, for example, airfield luminaires associated with the portion 106-1 of the airfield, transformers associated with the portion 106-1 of the airfield (e.g., associated with the taxiway), where the transformers allow for control of the airfield luminaires to allow the airfield luminaire to emit visible light to direct aircraft and/or other vehicles through the taxiway.

The SMCD 102-1-A can control the AGLOs 104-1, SMCD 102-1-B can control the AGLOs 104-2, and the SMCD 102-1-C can control the AGLOs 104-M in response to receiving a control signal. For example, a user (e.g., ATC, technician, or other user) may desire to control the AGLOs 104-1, 104-2, 104-M and a computing device (e.g., client device 110-1, 110-2, 110-O, ATC 114, etc.) can receive an input from the user. The computing device that receives the input can transmit a control signal (via the aggregator CMSCDs 108-1 or 108-2) to the SMCD 102-1-A, 102-1-B, 102-1-C in order to control the airfield ground lighting objects 104-1, 104-2, 104-M, respectively. The computing device that receives the input can be a client device 110-1, 110-2, 110-O, an ATC 114 computing device, etc. Accordingly, the SMCD 102-1-A, 102-1-B, 102-1-C can receive the control signal from a client device 110-1, 110-2, 110-O, an ATC 114 computing device, etc.

The SMCDs 102-1-A, 102-1-B, 102-1-C can control the AGLOs 104-1, 104-2, 104-M in various ways. In an example in which the airfield ground lighting objects 104-1, 104-2, 104-M include luminaires, the control signal can include instructions to cause the SMCD 102-1-A to control individual luminaires (e.g., turn on individual ones (e.g., two) of the AGLOs 104-1 but keep individual ones (e.g., one) of the AGLOs 104-1 turned off), control groups of luminaires (e.g., turn on AGLOs 104-1 and 104-M but leave AGLOs 104-2 turned off where AGLOs 104-1 and 104-M comprise a first group of AGLOs and AGLOs 104-2 comprise a second group of AGLOs), configure an alarm associated with AGLOs 104-1, 104-2, 104-M (e.g., if an AGLO 104-1 does not turn on or off after a predetermined amount of time following receiving the control signal, generate an alarm), suppressing the alarm associated with AGLOs 104-1, 104-2, 104-M, etc. In some examples in which the AGLOs 104-1, 104-2, 104-M include transformers associated with luminaires, the SMCDs 102-1-A, 102-1-B, 102-1-C can control such transformers.

Additionally, the SMCDs 102 can transmit status information about their corresponding AGLOs 104 to the aggregator CMSCDs 108-1, 108-2. Status information can include information to describe a current condition of a device. For example, status information about the AGLO 104-1 can include a health status of the AGLO 104-1, an operational status of the AGLO 104-1, an operational intensity of the AGLO 104-1, and/or a runtime of the AGLO 104-1, among other examples of status information, as is further described in connection with FIG. 2. The AGLOs 104 can each transmit respective status information to the SMCDs 102, and the SMCDs 102 can accordingly transmit the status information to the aggregator CMSCDs 108.

As illustrated in FIG. 1, the system 100 further includes SMCDs 102-2-A, 102-2-B, 102-2-C and 102-3-A, 102-3-B, 102-3-C. The SMCDs 102-2-A, 102 B, 102-2-C can also be computing devices that are in communication with AGLOs 104-3, 104-4, 104-N and SMCDs 102-3-A, 102-3-B, 102-3-C can be computing devices that are in communication with AGLOs 104-5, 104-6, 104-P. As mentioned above, the AGLOs 104-3, 104-4, 104-N can be associated with a portion 106-2 of the airfield and AGLOs 104-5, 104-6, 104-N can be associated with a portion 106-L of the airfield. In some embodiments, the portion 106-2 can be a runway. Accordingly, AGLOs 104-3, 104-4, 104-N can be, for example, airfield luminaires associated with the portion 106-2 of the airfield and/or transformers associated with the portion 106-2 of the airfield (e.g., associated with the runway), where the transformers allow for control of the airfield luminaires to allow the airfield luminaire to emit visible light to direct aircraft and/or other vehicles through the runway. Further, AGLOs 104-5, 104-6, 104-P can be, for example, airfield luminaires associated with the portion 106-L of the airfield and/or transformers associated with the portion 106-L of the airfield, where the transformers allow for control of the airfield luminaires to allow the airfield luminaire to emit visible light to direct aircraft and/or other vehicles through the portion 106-L.

The SMCDs 102-2-A, 102-2-B, 102-2-C can control the AGLOs 104-3, 104-4, 104-N and SMCDs 102-3-A, 102-3-B, 102-3-C can control AGLOs 104-5, 104-6, 104-N in response to receiving control signals. For example, a user (e.g., ATC, technician, or other user) may desire to control the AGLOs 104-3, 104-4, 104-N and a computing device (e.g., client device 110-1, 110-2, 110-O, ATC 114, etc.) can receive an input from the user. The computing device that receives the input can transmit a control signal (via the aggregator CMSCDs 108-1, 108-2) to the SMCDs 102-2-A, 102-2-B, 102-2-C in order to control the AGLOs 104-3, 104-4, 104-N. A similar approach can be utilized to control AGLOs 104-5, 104-6, 104-P via SMCDs 102-3-A, 102-3-B, and/or 102-3-C. The computing device that receives the input can be a client device 110-1, 110-2, 110-O, an ATC 114 computing device, etc. Accordingly, the SMCDs 102 can receive the control signal from a client device 110-1, 110-2, 110-O, an ATC 114 computing device, etc.

The SMCDs 102-2-A, 102-2-B, 102-2-C can control the AGLOs 104-3, 104-4, 104-N and the SMCDs 102-3-A, 102-3-B, 102-3-C can control the AGLOs 104-5, 104-6, 104-P in various ways. In an example in which the AGLOs 104-3, 104-4, 104-N include luminaires, the control signal can include instructions to cause the SMCDs 102-2-A, 102-2-B, 102-2-C to control individual luminaires (e.g., turn on AGLOs 104-3 but keep AGLOs 104-4 turned off), control groups of luminaires (e.g., turn on AGLOs 104-3 and 104-N but leave AGLOs 104-4 turned off where AGLOs 104-3 and 104-N comprise a first group of AGLOs and AGLOs 104-4 comprise a second group of AGLOs), configure an alarm associated with AGLOs 104-3, 104-4, 104-N (e.g., if an AGLO 104-3 transmits status information including a value that exceeds a threshold, generate an alarm), suppressing the alarm associated with AGLOs 104-3, 104-4, 104-N, etc. In some examples in which the AGLOs 104-3, 104-4, 104-N include transformers associated with luminaires, the SMCDs 102-2-A, 102-2-B, 102-2-C can control such transformers. Further, a similar approach may be utilized for the SMCDs 102-3-A, 102-3-B, 102-3-C to control AGLOs 104-5, 104-6, 104-P.

Additionally, the SMCDs 102-2-A, 102-2-B, 102-2-C and the SMCDs 102-3-A, 102-3-B, 102-3-C can transmit status information about the AGLOs 104-3, 104-4, 104-N and AGLOs 104-5, 104-6, 104-P, respectively, to the aggregator CMSCDs 108-1, 108-2. For example, status information about the AGLO 104-3 can include a health status of the AGLOs 104-3, an operational status of the AGLOs 104-3, an operational intensity of the AGLOs 104-3, and/or a runtime of the AGLOs 104-3, among other examples of status information, as is further described in connection with FIG. 2. The AGLOs 104-3, 104-4, 104-N, 104-5, 104-6, and 104-P can each transmit respective status information to their respective SMCDs 102, and the respective SMCDs 102 can accordingly transmit the status information to the aggregator CMSCDs 108-1, 108-2.

As such, distributed management of AGLOs as described above can allow for SMCDs 102-1-A, 102-1-B, 102-1-C to control AGLOs 104-1, 104-2, 104-M, SMCDs 102-2-A, 102-2-B, 102-2-C to control AGLOs 104-3, 104-4, 104-N, and SMCDs 102-3-A, 102-3-B, 102-3-C to control AGLOs 104-5, 104-6, 104-P, respectively, where SMCDs 102-1-A, 102-1-B, 102-1-C are associated with a first portion 106-1 of the airfield (e.g., a taxiway), SMCDs 102-2-A, 102-2-B, 102-2-C are associated with a second portion 106-2 of the airfield (e.g., a runway), and SMCDs 102-3-A, 102-3-B, 102-3-C are associated with a third portion 106-L of the airfield. That is, while AGLOs 104 can be setup as logical partitions associated with portions of the airfield, the AGLOs 104 can be controlled physically by separate SMCDs 102. As such, if the AGLOs 104-1, 104-2, 104-M associated with the portion 106-1 of the airfield experience an untoward event resulting in airfield ground lighting objects 104-1, 104-2, 104-M becoming non-operational or if the CMCDs 112-1-A, 112-1-B experience a problem, AGLOs 104-3, 104-4, 104-N, 104-5, 104-6, 104-P can still be operational. Accordingly, while the portion 106-1 of the airfield may not be operational, the portions 106-2 and 106-L can still be operational, preventing the entire airfield from being non-operational. Therefore, as illustrated in FIG. 1 and described above, within each portion 106 of the airfield 100, the portion 106 can include two CMCDs 112 in communication with SMCDs 102, and each SMCD 102 can control a group of AGLOs 104, where there can be any number of SMCDs controlling any number of groups of AGLOs 104 within a particular portion 106 of the airfield 100.

Although an untoward event is described above as causing AGLOs 104 associated with a particular portion 106 of an airfield from being non-operational, embodiments of the present disclosure are not so limited. For example, an event such as an airport expansion may cause certain portions 106 of the airfield from being non-operational as is further described herein. Further, an event such as an airport expansion may allow other portions 106 to continue to be operational while the portion 106-L is added, as is further described herein.

As mentioned above, the system 100 includes aggregator CMSCDs 108-1, 108-2. The aggregator CMSCDs 108-1, 108-2 can be in communication with the SMCDs 102. The aggregator CMSCDs 108-1, 108-2 can receive status information from the SMCDs 102 about the respective connected AGLOs 104.

The aggregator CMSCDs 108-1, 108-2 aggregate such status information about the AGLOs 104 received from the SMCDs. For example, the aggregator CMSCDs 108-1, 108-2 aggregate status information about the AGLOs 104-1, 104-2, 104-M received from the SMCDs 102-1-A, 102-1-B, 102-1-C, status information about the AGLOs 104-3, 104-4, 104-N received from the SMCDs 102-2-A, 102-2-B, 102-2C, and status information about the AGLOs 104-5, 104-6, 104-P, received from SMCDs 102-3-A, 102-3-B, 102-3-C. The aggregator CMSCDs 108-1, 108-2 can aggregate the status information from the respective AGLOs 104 into a summary form for use by an end user. For example, the aggregator CMSCDs 108-1, 108-2 can aggregate status information into tables, reports, etc. for analysis by an end user.

The aggregator CMSCDs 108-1, 108-2 can transmit the aggregated status information about the AGLOs 104 to a client device 110-1, 110-2, 110-O. A client device 110-1, 110-2, 110-O can be, for example, a computing device associated with a user. The user may be, for instance, an engineer, technician, etc. In some examples, the client device 110-1, 110-2, 110-O can be a mobile device of a user.

The aggregated status information can be viewed by the user via the client device 110-1, 110-2, 110-O. For example, a user may view the aggregated status information via client device 110-1 to determine whether AGLOs 104-1 and 104-2 are turned on and what their total runtime is. The user may view the aggregated status information to determine the AGLOs 104-1 and 104-2 are turned on and their total runtime is 1,208 hours. Further, the user may determine AGLOs 104-1 and 104-2 should be turned off (e.g., to perform maintenance operations on the AGLOs 104-1 and 104-2). Accordingly, the user can provide and the client device 110-1 can receive an input to turn off AGLOs 104-1 and 104-2. The client device 110-1 can transmit a control signal to the SMCD 102-1-A and to the SMCD 102-1-B (e.g., via the aggregator CMSCDs 108-1 or 108-2) to cause the SMCD 102-1-A to turn off the AGLOs 104-1 and cause SMCD 102-1-B to turn off AGLOs 104-2, as previously described above.

In some examples, the aggregator CMSCDs 108-1, 108-2 can transmit the aggregated status information about the AGLOs 104 to an external client 111. An external client 111 can be, for example, a computing device. The external client 111 can be a computing device outside of the lighting control and monitoring system. For example, the external client 111 can be, for instance, a computing device associated with flight information systems for the airport, photometric systems for the airfield ground lighting of the airport, etc. Such aggregated status information can be viewed by a user of the external client 111, the external client 111 can receive an input from a user, and/or can transmit a control signal to the SMCDs 102, similar to the client devices 110-1, 110-2, 110-O as described above.

The system 100 further includes central management computing devices (CMCDs). The CMCDs 112-1-A, 112-1-B can be in communication with the SMCDs 102-1-A, 102-1-B, and 102-1-C for the portion 106-1 of the airfield, CMCDs 112-2-A, 112-2-B can be in communication with the SMCDs 102-2-A, 102-2-B, and 102-2-C for the portion 106-2 of the airfield, and the CMCDs 112-3-A, 112-3-B can be in communication with the SMCDs 102-3-A, 102-3-B, and 102-3-C for the portion 106-L of the airfield. The CMCDs 112 can transmit status information about the AGLOs 104 to ATC 114. For example, the CMCDs 112-1-A and 112-1-B and ATC 114 can be computing devices, where an air traffic controller can utilize ATC 114 to direct and/or control vehicles around the airfield. The status information can be viewed at ATC 114 via an external interface 113 by a user (e.g., an air traffic controller). For example, the air traffic controller may view the status information to determine whether AGLOs 104-1 and 104-2 are turned on. Since ATC 114 is a system outside of the lighting control and monitoring system, the external interface 113 can be a module to integrate the lighting control and monitoring system with ATC 114.

CMCDs 112 can control operational workflow of the AGLOs 104. For example, CMCDs 112 stores AGLO sectioning information, such as a portion 106-1 (e.g., a runway) being set to "ARRIVAL" mode, where in such a mode CMCDs 112-1-A and 112-1-B control which AGLOs 104-1, 104-2, 104-M are turned on or off, at what intensity setting the AGLOs 104-1, 104-2, 104-M that are turned on are operating at, and/or other information associated with the operational mode of the portion 106. Additionally, CMCDs 112 control operations of AGLOs 104 based on commands from ATC 114. For example, when an aircraft at the airport wants to enter into a runway (e.g., portion 106-1), CMCDs 112-1-A and 112-1-B determine which AGLOs 104-1, 104-2, 104-M are activated/inactivated (e.g., which all stop bar lights are to be inactivated and which Lead-ON lights are to be switched on to lead the aircraft onto the runway, etc.). Such commands can be transmitted from the CMCDs 112 to the SMCDs 102. The SMCDs 102 then, in response, transmit the commands to the AGLOs 104 to cause the AGLOs 104 to be operational or not according to the operational workflows of the CMCDs 112.

Additionally, SMCDs 102 can transmit commands to AGLOs 104 for maintenance operations of the AGLOs 104. That is, SMCDs 102 can maintain the device states of the AGLOs 104. For example, SMCDs 102 can store which AGLOs 104 (e.g., and associated circuits, including lamps, transformers, etc.) are in maintenance mode. During maintenance mode, a user can switch on/off various AGLOs 104 to test whether maintenance operations are properly executed or not. The SMCDs 102 can transmit the commands to the AGLOs 104 to control the AGLOs 104 accordingly.

The air traffic controller may view the status information to determine the AGLOs 104-1 and 104-2 are turned on. Further, the air traffic controller may determine AGLOs 104-1 and 104-2 should be turned off (e.g., based on the operating category of the airfield (e.g., CAT I, CAT II, etc.)). Accordingly, the air traffic controller can provide and the ATC 114 can receive an input to turn off AGLOs 104-1 and 104-2. The ATC 114 can transmit a control signal to the SMCD 102-1-A and 102-1-B (e.g., via the CMCDs 112-1-A or 112-1-B) to cause the SMCD 102-1-A to turn off the AGLOs 104-1 and cause the SMCD 102-1-B to turn off AGLOs 104-2.

As illustrated in FIG. 1, the system 100 can further include an event database 116. The event database 116 can be a database that records events associated with the AGLOs 104-1, 104-2, 104-M, 104-3, 104-4, 104-N, 104-5, 104-6, 104-P. An event can include, for instance, an action that is recognized by a computing device. For example, an event can include an AGLO 104 turning on or off, causing an alarm, and/or any other change in status of the AGLO 104. For instance, a user providing an input to client device 110-1 and the client device 110-1 transmitting a control signal to the SMCD 102-1-C can be an event recorded by the event database 116. Further, the control signal provided from the SMCD 102-1-C to the AGLO 104-M to cause the AGLO 104-M to turn on can be an event recorded by the event database 116. The event can be determined to have occurred by the SMCD 102-1-C.

The event database 116 can be a computing device (e.g., a server) located locally at the airfield. However, embodiments of the present disclosure are not so limited. For example, the event database 116 can be a remote computing device from the airfield connected to computing devices in the system 100 (e.g., SMCDs 102, CMCDs 112, aggregator CMSCDs 108, client devices 110, external clients 111, and/or ATC 114, etc.) via a network relationship (e.g., a wired or wireless network relationship).

Although not illustrated in FIG. 1 for clarity and so as not to obscure embodiments of the present disclosure, the aggregator CMSCDs 108-1, 108-2 and the SMCDs 102 can include redundant backup computing devices. For example, the aggregator CMSCDs 108-1, 108-2 can include a redundant backup CMSCD that can perform operations relating to the aggregator CMSCDs 108 (e.g., as described above) in the event the aggregator CMSCDs 108-1, 108-2 are non-operational, the SMCDs 102 can include redundant backup SMCDs that can perform operations relating to the SMCDs 102 (e.g., as described above) in the event an SMCD 102 is non-operational, etc.

Further, although not illustrated in FIG. 1 for clarity and so as not to obscure embodiment of the present disclosure, the system 100 can include network switches. Network switches can be utilized to connect computing devices within the system 100. For example, network switches may be utilized to connect SMCDs 102, CMCDs 112, aggregator CMSCDs 108, ATC 114, client devices 110, and/or external clients 111 to allow such devices to send and/or receive packets therebetween. Each network port of the network switches can be monitored. Some ports can be configured as "mandatorily connected", some ports can be configured as "should not be connected", some ports can be configured as "optionally connected", among other port designations. In an example in which a user connects to a network switch port that is configured as "should not be connected", an alarm can be generated and transmitted (e.g., to client devices 110, external clients 111, ATC 114, etc.). Similarly, if a user disconnects a port that is configured as "mandatorily connected", an alarm can be generated and transmitted (e.g., to client devices 110, external clients 111, ATC 114, etc.). In an example in which a network switch goes offline, an alarm can be generated and transmitted (e.g., to client devices 110, external clients 111, ATC 114, etc.).

In some examples, the airfield may undergo an expansion by adding another portion 106-L to the airfield. For example, the airfield may add another runway. The additional runway can be the third portion 106-L of the airfield. The system 100 can have SMCDs 102-3-A, 102-3-B, and 102-3-C added for the third portion 106-L of the airfield. The aggregator CMSCDs 108-1, 108-2 can, accordingly, add the SMCDs 102-3-A, 102-3-B, 102-3-C to the system 100. The SMCD 102-3-A can be in communication with associated AGLOs 104-5, the SMCD 102-3-B can be in communication with associated AGLOs 104-6, and the SMCD 102-3-C can be in communication with associated AGLOs 104-P. The SMCDs 102-3-A, 102-3-B, 102-3-C can control AGLOs 104-5, 104-6, 104-P, respectively, in response to receiving a control signal. Further, the AGLOs 104-5, 104-6, and 104-P can each transmit respective status information to the SMCDs 102-3-A, 102-3-B, 102-3-C, and the SMCDs 102-3-A, 102-3-B, 102-3-C can accordingly transmit the status information to the aggregator CMSCDs 108-1, 108-2.

Operation of the AGLOs 104 by the SMCDs 102 can be performed via configuration files. A configuration file can be, for example, a file to configure parameters and settings for computing device operations. For example, SMCD 102-2-A can control the AGLOs 104-3 via a configuration file that defines various types of objects (e.g., airfield ground lighting objects) and their relationships. Accordingly, when the portion 106-L is added to the airfield, additional configuration files can be added to the system 100. The configuration file can define relationships between AGLOs 104-5, 104-6, 104-P, SMCDs 102-3-A, 102-3-B, 102-3-C, CMCD 112-3-A, 112-3-B, etc. The configuration file can be automatically distributed to various computing devices within the system 100 (e.g., client devices 110, external client 111, ATC 114, aggregator CMSCDs 108, CMCDs 112, SMCDs 102, etc.). Once the configuration file is distributed and applicable machine processes are restarted, portion 106-L can be operational, including the AGLOs 104, SMCDs 102, and CMCDs 112 included therein.

The aggregator CMSCDs 108-1, 108-2 can add the SMCDs 102-3-A, 102-3-B, 102-3-C while the AGLOs 104-1, 104-2, 104-M associated with the portion 106-1 of the airfield and the AGLOs 104-3, 104-4, 104-N associated with the portion 106-2 of the airfield are operational. That is, the portions 106-1 and/or 106-2 (e.g., the AGLOs 104-1, 104-2, 104-M, 104-3, 104-4, 104-N) of the airfield can remain operational while the portion 106-L of the airfield is added (e.g., is constructed). Thus, distributed management of AGLOs according to the present disclosure can allow the airfield to remain operational (e.g., allow portions 106-1 and 106-2 and associated AGLOs 104 to remain operational), reducing operational downtime as compared with previous approaches.

In some examples, the airfield may undergo an expansion by adding to an existing portion 106-2 of the airfield. For example, the airfield may add an additional airfield luminaire to the portion 106-2. The additional luminaire can be, for example, AGLO 104-N. The aggregator CMSCDs 108-1, 108-2 can, accordingly, add the AGLO 104-N to the system 100. For example, a configuration file can be added to the system 100 corresponding to the AGLO 104-N and automatically distributed to various computing devices within the system 100, as described above. The SMCD 102-2-C can be in communication with the airfield object 104-N. The SMCD 102-2-C can control the additional airfield object 104-N in response to receiving a control signal when the AGLO 104-N is operational following distribution of the configuration file. Further, the airfield object 104-N can transmit respective status information to the SMCD 102-2-C, and the SMCD 102-2-C can accordingly transmit the status information to the aggregator CMSCDs 108-1, 108-2.

The aggregator CMSCDs 108-1, 108-2 can add the additional airfield object 104-N while the AGLOs 104-1, 104-2, 104-M associated with the portion 106-1 of the airfield (e.g., and the AGLOs 104-5, 104-6, and 104-P associated with the portion 106-L of the airfield) are operational. That is, the portions 106-1 and/or 106-L (e.g., the AGLOs 104-1, 104-2, 104-M, 104-3, 104-4, 104-6, 104-P) of the airfield can remain operational while the additional airfield object 104-N is added (e.g., is installed). Thus, distributed management of airfield ground lighting objects according to the present disclosure can allow the airfield to remain operational (e.g., allow portions 106-1 and 106-L and associated AGLOs 104 to remain operational), reducing operational downtime as compared with previous approaches.

FIG. 2 is an example of status information 218 of an airport ground lighting object, in accordance with one or more embodiments of the present disclosure. The status information 218 can include various entries 220.

As previously described in connection with FIG. 1, an airfield ground lighting object can transmit status information 218 to an aggregator CMSCD. The status information 218 can be aggregated by the aggregator CMSCD into, for example, a table as illustrated in FIG. 2.

The status information 218 can include information describing a current condition of the airfield ground lighting object. For example, the table illustrated in FIG. 2 can include various entries 220 generated by the aggregator CMSCD. For instance, the entry 220-1 can include a health status of the airfield ground lighting object. The health status can be, for example, healthy, indicating the airfield ground lighting object is working as intended and there are no detected faults associated with the airfield ground lighting object.

The entry 220-2 can indicate an operational status of the airfield ground lighting object. For example, the airfield ground lighting object can be an airfield luminaire, and the entry 220-2 indicates the operational status of the airfield luminaire is on (e.g., is emitting visible light in an area of the airfield where the airfield luminaire is located) and not off.

The entry 220-3 can indicate an operational intensity of the airfield ground lighting object. For example, the entry 220-3 can indicate that the airfield luminaire is operating at a high intensity. The intensity level may be, in some examples, associated with an operational category of the airfield (e.g., CAT I, CAT II, etc.).

Lastly, the entry 220-4 can indicate a runtime of the airfield ground lighting object. For example, the entry 220-4 can indicate the airfield luminaire has been operating (e.g., and/or operating at the high intensity level) for 1,037 hours. The runtime may indicate to a user whether the airfield ground lighting object should be replaced (e.g., if the runtime exceeds a runtime threshold), among other examples.

The status information 218 can be aggregated by the aggregator CMSCD for each airfield ground lighting object controlled by each SMCD. A user can view the status information for each airfield object via a client device, an ATC computing device, etc.

Figure 3:
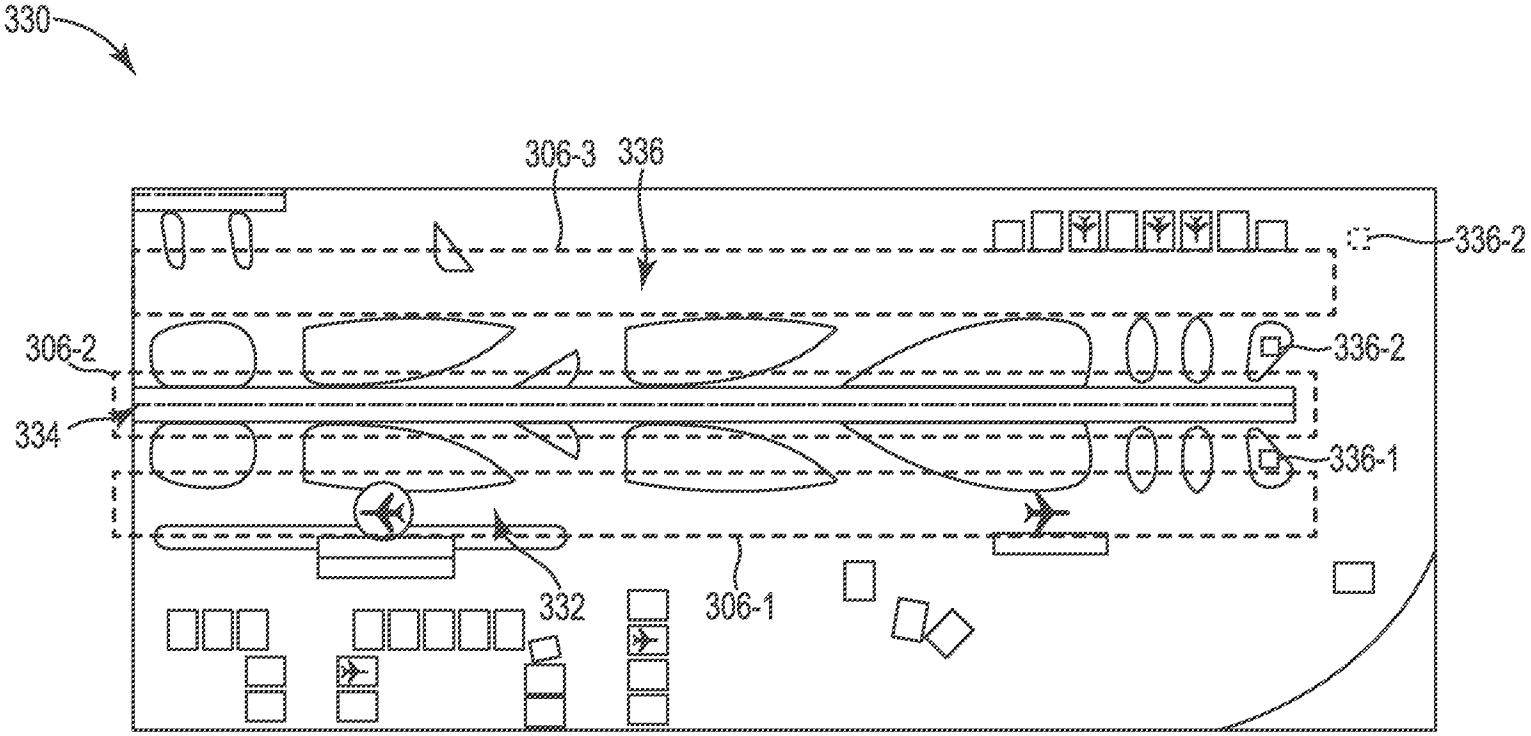
FIG. 3 is an example of an airfield for distributed management of airfield ground lighting objects, in accordance with one or more embodiments of the present disclosure.

FIG. 3 is an example of an airfield 330 for distributed management of airfield ground lighting objects, in accordance with one or more embodiments of the present disclosure. The airfield 330 can include portions 306-1, 306-2 and substations 336-1, 336-2.

As previously described in connection with FIG. 1, the airfield 330 can include different portions 306-1, 306-2. For example, the portion 306-1 can be a taxiway 332 and the portion 306-2 can be a runway 334. The taxiway 332 can include various associated AGLOs (e.g., not illustrated in FIG. 3 for clarity and so as not to obscure embodiments of the present disclosure). For example, the taxiway 332 can include various airfield luminaires, transformers, etc. to allow the airfield luminaires to direct aircraft and/or other vehicles through the taxiway 332.

As illustrated in FIG. 3, the airfield 330 can include a substation 336-1. The substation 336-1 can be associated with the taxiway 332 (e.g., the portion 306-1 of the airfield 330) and in some examples can include equipment that performs voltage transformations (e.g., transform voltage from high to low or vice versa). The substation 336-1 can include a first SMCD (e.g., SMCD 102-1, previously described in connection with FIG. 1) associated with the taxiway 332. The first SMCD can control AGLOs associated with the taxiway 332, receive status information from the AGLOs associated with the taxiway 332, and transmit the status information from the AGLOs associated with the taxiway 332 to an aggregator CMSCD.

Additionally, the portion 306-2 can be a runway 334. The runway 334 can include various associated AGLOs (e.g., not illustrated in FIG. 3 for clarity and so as not to obscure embodiments of the present disclosure). For example, the runway 334 can include various airfield luminaires, transformers, etc. to allow the airfield luminaires to direct aircraft and/or other vehicles through the runway 334.

As illustrated in FIG. 3, the airfield 330 can include a substation 336-2. The substation 336-2 can be associated with the runway 334 (e.g., the portion 306-2 of the airfield 330) and in some examples can include equipment that performs voltage transformations (e.g., transform voltage from high to low or vice versa). The substation 336-2 can include a second SMCD (e.g., SMCD 102-2, previously described in connection with FIG. 1) associated with the runway 334. The second SMCD can control AGLOs associated with the runway 334, receive status information from the AGLOs associated with the runway 334, and transmit the status information from the AGLOs associated with the runway 334 to an aggregator CMSCD.

As previously described in connection with FIG. 1, in some examples, the airfield 330 can undergo expansion by adding a third portion 306-3 to the airfield 330, where the additional third portion 306-3 is another taxiway 336. In some examples, the SMCD located in the substation 336-2 can be utilized to control AGLOs associated with the third portion 306-3. In some examples, an additional SMCD located in a new substation 336-3 can be utilized to control the AGLOs associated with the third portion 306-3.

Figure 4:
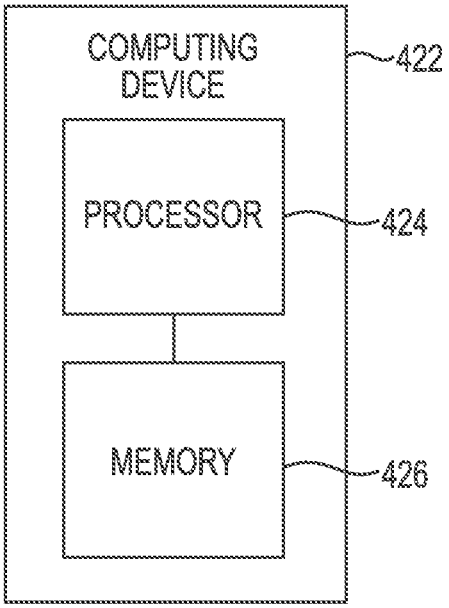
FIG. 4 is an example of a computing device for distributed management of airfield ground lighting objects, in accordance with one or more embodiments of the present disclosure.

FIG. 4 is an example of a computing device 422 for distributed management of airfield ground lighting objects, in accordance with one or more embodiments of the present disclosure. As illustrated in FIG. 4, the computing device 422 can include a memory 426 and a processor 424 for distributed management of airfield ground lighting objects in accordance with the present disclosure.

The memory 426 can be any type of storage medium that can be accessed by the processor 424 to perform various examples of the present disclosure. For example, the memory 426 can be a non-transitory computer readable medium having computer readable instructions (e.g., executable instructions/computer program instructions) stored thereon that are executable by the processor 424 for distributed management of airfield ground lighting objects in accordance with the present disclosure. Accordingly, the computing device 422 can be, for instance, an SMCD, an aggregator CMSCD, a client device, a CMCD, an ATC computing device, an event database, etc. Additionally, the computing device 422 can be, for instance, a redundant backup SMCD, a redundant backup aggregator CMSCD, a redundant backup CMCD, and/or a redundant backup event database, among other examples.

The memory 426 can be volatile or nonvolatile memory. The memory 426 can also be removable (e.g., portable) memory, or non-removable (e.g., internal) memory. For example, the memory 426 can be random access memory (RAM) (e.g., dynamic random access memory (DRAM) and/or phase change random access memory (PCRAM)), read-only memory (ROM) (e.g., electrically erasable programmable read-only memory (EEPROM) and/or compact-disc read-only memory (CD-ROM)), flash memory, a laser disc, a digital versatile disc (DVD) or other optical storage, and/or a magnetic medium such as magnetic cassettes, tapes, or disks, among other types of memory.

Further, although memory 426 is illustrated as being located within computing device 422, embodiments of the present disclosure are not so limited. For example, memory 426 can also be located internal to another computing resource (e.g., enabling computer readable instructions to be downloaded over the Internet or another wired or wireless connection).

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A system for distributed management of airfield ground lighting objects, comprising:

an aggregator control and monitoring system computing device (CMSCD);

a first substation management computing device (SMCD) in communication with the aggregator CMSCD, wherein:

the first SMCD is in communication with a first number of airfield ground lighting objects associated with a first portion of an airfield, wherein the first portion is a first physical area of the airfield; and the first SMCD is configured to control the first number of airfield ground lighting objects in response to receiving a control signal; and a second SMCD in communication with the aggregator CMSCD, wherein:

the second SMCD is in communication with a second number of airfield ground lighting objects associated with a second portion of the airfield, wherein the second portion is a second physical area of the airfield different than the first physical area; and the second SMCD is configured to control the second number of airfield ground lighting objects in response to receiving a different control signal;

wherein:

the aggregator CMSCD is configured to aggregate status information about the first number of airfield ground lighting objects received from the first SMCD and status information about the second number of airfield ground lighting objects received from the second SMCD for transmission to a client device;

the status information about the first number of airfield ground lighting objects and the second number of airfield ground lighting objects includes:

an operational status of each respective object including whether each respective object is on or off; and an operational intensity associated with an operational category of the airfield of each respective object; and the first SMCD is configured to control the first number of airfield ground lighting objects and the second SMCD is configured to control the second number of airfield ground lighting objects separately from the first number of airfield ground lighting objects to keep the second number of airfield ground lighting objects operational upon the first number of airfield ground lighting objects becoming non-operational.

2. The system of claim 1, wherein:

the first SMCD is configured to transmit the status information about the first number of airfield ground lighting objects to the aggregator CMSCD; and the second SMCD is configured to transmit the status information about the second number of airfield ground lighting objects to the aggregator CMSCD.

3. The system of claim 1, wherein the status information about the first number of airfield ground lighting objects and the second number of airfield ground lighting objects further includes at least one of:

a health status of each respective object; and a runtime of each respective object.

4. The system of claim 1, wherein the first SMCD is located in a first substation associated with the first portion of the airfield and the second SMCD is located in a second substation associated with the second portion of the airfield.

5. The system of claim 1, wherein the first portion of the airfield is a taxiway.

6. The system of claim 1, wherein the second portion of the airfield is a runway.

7. The system of claim 1, wherein:

the first number of airfield ground lighting objects include at least one of:

luminaires associated with the first portion of the airfield;

transformers associated with the first portion of the airfield; and switches associated with the first portion of the airfield; and the second number of airfield ground lighting objects include at least one of:

luminaires associated with the second portion of the airfield;

transformers associated with the second portion of the airfield; and switches associated with the second portion of the airfield.

8. A system for distributed management of airfield ground lighting objects, comprising:

an aggregator control and monitoring system computing device (CMSCD);

a first substation management computing device (SMCD) connected to the CMSCD, wherein:

the first SMCD is in communication with a first number of airfield ground lighting objects associated with a first portion of an airfield, wherein the first portion is a first physical area of the airfield; and the first SMCD is configured to:

control the first number of airfield ground lighting objects in response to receiving a control signal; and transmit status information about the first number of airfield ground lighting objects to the aggregator CMSCD;

a second SMCD connected to the CMSCD, wherein:

the second SMCD is in communication with a second number of airfield ground lighting objects associated with a second portion of the airfield, wherein the second portion is a second physical area of the airfield different than the first physical area; and the second SMCD is configured to:

control the second number of airfield ground lighting objects in response to receiving a different control signal; and transmit status information about the second number of airfield ground lighting objects to the aggregator CMSCD;

wherein:

the aggregator CMSCD is configured to aggregate the status information about the first number of airfield ground lighting objects received from the first SMCD and the status information about the second number of airfield ground lighting objects received from the second SMCD for transmission to a client device;

the status information about the first number of airfield ground lighting objects and the second number of airfield ground lighting objects includes:

an operational status of each respective object including whether each respective object is on or off; and an operational intensity associated with an operational category of the airfield of each respective object; and the first SMCD is configured to control the first number of airfield ground lighting objects and the second SMCD is configured to control the second number of airfield ground lighting objects separately from the first number of airfield ground lighting objects to keep the second number of airfield ground lighting objects operational upon the first number of airfield ground lighting objects becoming non-operational.

9. The system of claim 8, wherein the aggregator CMSCD is configured to transmit the aggregated status information about the first number of airfield ground lighting objects and the status information about the second number of airfield ground lighting objects to the client device.

10. The system of claim 8, wherein the system further includes a central management computing device (CMCD) in communication with the first SMCD and the second SMCD.

11. The system of claim 10, wherein the CMCD is configured to transmit the status information about the first number of airfield ground lighting objects and the second number of airfield ground lighting objects to air traffic control (ATC).

12. The system of claim 8, wherein the first SMCD is configured to control the first number of airfield ground lighting objects in response to receiving the control signal by:

controlling individual luminaires associated with the first portion of the airfield;

controlling groups of luminaires associated with the first portion of the airfield;

configuring an alarm associated with the individual luminaires associated with the first portion of the airfield;

suppressing the alarm; or control of transformers associated with the individual luminaires.

13. The system of claim 8, wherein the control signal is received by the first SMCD from a client device.

14. The system of claim 8, wherein:

the system further includes an event database; and events associated with the first number of airfield ground lighting objects and the second number of airfield ground lighting objects are recorded in the event database.

15. The system of claim 8, wherein each of the aggregator CMSCD, the first SMCD, and the second SMCD include redundant backup computing devices.

16. A method for distributed management of airfield ground lighting objects, comprising:

transmitting, by a first substation management computing device (SMCD), status information about a first number of airfield ground lighting objects associated with a first portion of an airfield to an aggregator control and monitoring system computing device (CMSCD), wherein the first portion is a first physical area of the airfield;

transmitting, by a second SMCD, status information about a second number of airfield ground lighting objects associated with a second portion of the airfield to the aggregator CMSCD, wherein the second portion is a second physical area of the airfield different than the first physical area;

aggregating, by the aggregator CMSCD, the status information about the first number of airfield ground lighting objects and the status information about the second number of airfield ground lighting objects, wherein the status information about the first number of airfield ground lighting objects and the second number of airfield ground lighting objects includes:

an operational status of each respective object including whether each respective object is on or off; and an operational intensity associated with an operational category of the airfield of each respective object; and transmitting, by the aggregator CMSCD, the aggregated information to a client device; and controlling, by the first SMCD in response to receiving a control signal from the client device via the aggregator CMSCD, the first number of airfield ground lighting objects, wherein the first SMCD is configured to control the first number of airfield ground lighting objects separately from the second SMCD controlling the second number of airfield ground lighting objects to keep the second number of airfield ground lighting objects operational upon the first number of airfield ground lighting objects becoming non-operational.

17. The method of claim 16, wherein the method includes controlling, by the second SMCD in response to receiving a different control signal from the client device via the aggregator CMSCD, the second number of airfield ground lighting objects.

18. The method of claim 16, wherein the method includes adding, by the aggregator CMSCD, a third SMCD having a third number of airfield ground lighting objects associated with a third portion of the airfield for control while the first number of airfield ground lighting objects and the second number of airfield ground lighting objects are operational, wherein the third SMCD is configured to transmit status information about the third number of airfield ground lighting objects to the aggregator CMSCD.

19. The method of claim 16, wherein:

the method includes adding, by the aggregator CMSCD, additional airfield ground lighting objects for control to the second number of airfield ground lighting objects while the first number of airfield ground lighting objects are operational;

the second number of airfield ground lighting objects are not operational; and the second SMCD is configured to transmit status information about the second number of airfield ground lighting objects and the additional airfield ground lighting objects to the aggregator CMSCD.

* * * * *